US006550188B2

(12) United States Patent
Bolinger et al.

(10) Patent No.: US 6,550,188 B2
(45) Date of Patent: Apr. 22, 2003

(54) ADJUSTABLE SCAFFOLD USED WITH CONCRETE-RECEIVING FORMS

(76) Inventors: David N. Bolinger, G3191 Richfield Rd., Flint, MI (US) 48506; Edward J. Ross, G3191 Richfield Rd., Flint, MI (US) 48506

( * ) Notice: Subject to any disclaimer, the term of this patent is extended or adjusted under 35 U.S.C. 154(b) by 216 days.

(21) Appl. No.: 09/740,506

(22) Filed: Dec. 19, 2000

(65) Prior Publication Data

US 2002/0073634 A1 Jun. 20, 2002

(51) Int. Cl.[7] ..... E04G 25/00; E04G 23/04; E04G 21/26

(52) U.S. Cl. ..... 52/127.2; 52/149; 52/150; 248/235; 248/241; 248/351; 182/82

(58) Field of Search ..... 52/127.2, 745, 52/745.12, 149, 150; 248/235, 351, 354.3, 354.5, 241; 182/82, 230

(56) References Cited

U.S. PATENT DOCUMENTS 4,068,427 A * 1/1978 Camardo ..... 52/127.2
4,979,725 A * 12/1990 Hutchings, II et al. ..... 256/64
5,388,663 A * 2/1995 Philippe et al. ..... 182/82
6,065,254 A * 5/2000 Lanka ..... 52/127.2
6,247,273 B1 * 6/2001 Nickel ..... 52/127.2
6,446,752 B2 * 9/2002 Philippe ..... 182/82
2002/0003061 A1 * 1/2002 Philippe ..... 182/82

* cited by examiner

*Primary Examiner*—Robert Canfield
(74) *Attorney, Agent, or Firm*—James C. McLaughlin

(57) ABSTRACT

Walls of expanded polystyrene, concrete-receiving forms (referred to as insulated or insulating concrete forms or ICFs) need to be vertical while they are being filled with concrete and while the concrete is curing. An apparatus with a vertical member and a brace member is such that one person can erect it and use it to adjust walls of ICFs so as to be vertical or plumb. The apparatus is capable of being readily used with the forms of any manufacturer by being provided with asymmetrical brackets for detachably attaching the vertical member to a wall firmly, but not rigidly. The apparatus provides a support for a platform, or scaffold, for a person to stand on while guiding the concrete pouring and while plumbing the wall. The vertical member extends upward from the ground and is held firmly against the wall with asymmetrical brackets. The brace member extends from the vertical member at a pivot with the other end of the brace member attached to the ground or floor. A lead screw in the vertical member is used to change the height of the pivot and thus slightly, and adjustably, tilt the vertical member into or out of the wall so as to cause the wall to be vertical. The vertical member and the brace member are preferably adjustable in length, however neither member changes length a noticeable amount while being used to cause the wall to be vertical. The members are preferably made of sections of square cross section, steel tubing that may be nested together.

21 Claims, 9 Drawing Sheets

ADJUSTABLE SCAFFOLD USED WITH CONCRETE-RECEIVING FORMS

TECHNICAL FIELD OF THE INVENTION

The field of the invention is that of apparatus:

used to cause walls of plastic, concrete-receiving forms to be vertical before and during the pouring of concrete slurry into the forms; and used to provide a platform (scaffold) for a person to stand on safely while guiding the pouring of concrete slurry.

The plastic most used for such forms is expanded polystyrene and the plastic shall be so described although other types of plastic might be used.

The field of the invention also includes such apparatus that one person can erect and use to adjust walls of expanded polystyrene, concrete-receiving forms so as to be vertical. The field of the invention further includes such apparatus that may readily be used with the expanded polystyrene, concrete-receiving forms of any manufacturer.

BACKGROUND INFORMATION

A method of constructing high quality walls has become popular, especially in areas with cold Winters or hot Summers. This method uses a quantity of expanded polystyrene, concrete-receiving forms to effect a wall into which is poured concrete slurry. The result is a solid wall with a concrete core and an expanded polystyrene, insulating outside. The resulting wall is strong, tends to have very little air or vermin intrusion, and provides excellent thermal insulation. The technique of using such forms and concrete is believed to be about fifty years old with at least a score of companies presently selling such forms in North America.

The expanded polystyrene, concrete-receiving forms (also herein, and in the industry, referred to as insulated or insulating concrete forms or ICFs) are most often cast using an air-entrapped plastic or foam such as expanded polystyrene, are light enough to be stacked as a wall with little effort, and include some type of keying so that adjacent forms partially fit, or lock, into each other. Voids are provided within the forms, communicating with each other, into which, in due course, concrete and reinforcing rods are placed. Imbedded near, or on, the outside surface of the forms are studs which are stiff strips of material into which one may attach cladding, or the like, using fasteners such as screws. The forms are stacked and locked to each other such that the studs are alined in a set of vertical columns with a fixed horizontal spacing between adjacent columns of studs that differs between manufactures of the forms.

Additional information about ICFs may be found in the Internet site of the Insulating Concrete Form Association at: http://www.forms.org/. Further information may be found in the commercial Internet site of: http://www.icfwveb.com/. A representative block ICF, appropriate for use with the present invention, is described in U.S. Pat. No. 5,428,933 (which is incorporated herewith by reference) and is sold by the Phil-Insul Corporation under the trade name of IntegraSpec. Further information about this ICF may be found in the Internet site of the Phil-Insul Corporation at: http://www.Phil-Insul-Corp.com.

An inherent problem with the use of ICFs is having a wall of ICFs be vertical both just before concrete is poured into the forms and while concrete is poured into the forms. The desirability of maintaining a vertical wall of forms is obvious. A well known part of the solution to the problem involves using a concrete slurry with an appropriate viscosity. Additionally, it is known to place a horizontally extending sequence of flat pieces of wood, or the like, against the wall of foam blocks vertically and to brace each vertical piece with a diagonal brace (called a "kicker") that extends from the vertical piece to the floor or ground. For each such pair of vertical piece and kicker, one member of a crew monitors the plumb of the wall and communicates to a second member of the crew while that member of the crew adjusts the length of the kicker until the wall of blocks is about vertical near the relevant vertical piece. The success of this scheme depends on the stiffness of the vertical piece, the care taken by a two person crew, and the degree of adjustability of the length of the kicker. With the common kicker formed of overlapping boards that are nailed or clamped together, adjustability is limited.

The ReechCraft company might make a kicker that is adjustable in length. Their Panel Jack System appears to consist of an aluminum channel used as a vertical-member and a cylindrical brace-member described as being able to be adjusted in length with a "twist." It further appears that the channel vertical-member is screwed directly into the ICF wall's studs and has no provision for accommodating to wall movement. Further information may be available in the Internet site of ReechCraft at http://www.reechcraft.com/paneljack/

The objectives of the present invention include a apparatus for causing a wall of ICFs blocks to be vertical and include:

1 an adjustable length vertical-member of ample stiffness while maintaining a weight such that one person may readily move the apparatus from place to place;

2 an adjustable length brace-member that needs no further adjustment once it is affixed to the floor or ground;

3 an adjustment scheme, usable by one person who is situated in a favorable position to determine the plumb of a wall of ICF blocks, to bring the wall into plumb without the need for any tools;

4 a scheme for temporarily attaching vertical-members to the studs in a wall of ICF blocks independently of the horizontal spacing of the studs and able to accommodate slight vertical movement of the ICFs; and 5 a bracket suspended from the vertical-member for implementing a safe scaffold for supporting the person adjusting the plumb of the wall of ICF blocks and for supporting the person guiding the filling of the forms with concrete;

SUMMARY OF THE INVENTION

The preferred embodiment of the present invention, as most likely seen by a user removing the invention from the bed of a pickup truck, is a nested set of three telescoping, square cross section metal tubes (forming the vertical-member) to which is pivotally attached the top brace-member (itself a square cross section tube) and a bundle of two more telescoping brace-members. The pivot extends from the side of the top vertical-member. Accompanying the two sets of pivotally connected telescoping tubes (one set forming a vertical-member and the other set forming a brace-member) are asymmetrical P-brackets (used to attach the vertical-members to the wall firmly; that is: with slight looseness), a platform-bracket (used to hold the platform and railing-post that constitutes the major parts of a scaffold), and a set of stout pins. The platform-bracket or the pins could be detachably attached to the members or loose.

The user will place the vertical members vertically against the ICF wall just to one side of a column of studs such that the pivot is directly in front of a column of studs. The user will extend the vertical members so that they reach from the floor or ground to a desired height and then place pins through pairs of vertical members (through cooperating holes provided for that purpose) so as to fix the height of the assembly. The foot of the bottom vertical-member is affixed to the ground or floor and the foot is capable of flexing. The setting of the height of the total vertical-member may be performed prior to placing the total vertical-member against the ICF wall. Both flanges of several vertically distributed P-brackets will be detachably attached to the studs while each P-bracket surrounds the vertical-members. The surrounding is such that the vertical member is held up while allowing for slight vertical movement of the wall of ICFs when the wall is made vertical (by the scheme shortly to be described) and when the concrete slurry is poured into the forms. This firm, but not solid, attachment to a wall of ICFs by the vertical member is an important feature of the present invention. The shorter flange of each P-bracket will be attached to, and aligned with, the column of studs that are directly behind the pivot. It is preferred that the shorter flange of each P-bracket be attached to a stud within four inches of the nearest side of the vertical member. This too is an important feature of the present invention as it causes the force produced in the brace member to react almost directly in line with a stud without producing significant torque. The longer flange of each P-bracket will be attached to studs in the adjacent column (an adjacent stud). This is possible, in spite of different manufacturers using different horizontal spacings between studs, because the longer flange has a series of spaced holes such that at least one set is able to reach any adjacent stud. This is an additional important feature of the present invention.

It is known to attach the vertical member to a wall in other ways. Attachment flanges could slide within grooves or slots. Attachment flanges could be afixed to the vertical member.

Once the vertical-members are detachably attached to the ICF wall, the brace-members are extended a convenient distance to the floor or ground at roughly 45 degrees. Pins are placed through pairs of brace-members (through cooperating holes provided for the purpose) so as to fix the length of the whole brace-member. Then the ground touching end of the brace is fixed to the ground with a stake or the like. While the acute angle between the vertical member and the attached brace member is preferably roughly 45 degrees, that acute angle may be less than ninety degrees and more than two degrees.

A scaffold is implemented after a number of pairs of vertical-members and brace-members have been mounted equally spaced horizontally along an ICF wall. A clevis attached to the top vertical-member supports a platform-bracket at an appropriate height. Strong plastic sheets are placed on top of adjacent platform-brackets to form a flat, horizontal platform. Wood planking, or the like, could also be used. The platform may be temporarily affixed to platform-brackets. The outside edge of the platform-brackets are fitted with a railing-post retainer into which a post is vertically retained and used to form a safety railing.

Once the set of vertical-members and the set of brace-members have been pinned together and attached appropriately to the floor or ground, and a scaffold implemented, it is time to use the device to plumb the ICF wall. Through the top vertical-member runs a lead screw from a crank at the top of the top vertical-member to the pivot with the top brace-member, so arranged that as the crank is turned the pivot is moved vertically either up or down. Clearly, as the pivot is moved vertically, the vertical-member will press more or less against the ICF wall and the vertical-member will be expected to tilt slightly. Plumbing the wall is a simple process that may, and can, be implemented by one person with ease and safety. The person doing the adjustment stands on the scaffold platform with a plumb-bob or bubble level in one hand that detects the plumb of the vertical-member, or wall, while the person rotates the crank with the other hand in the proper direction by the proper amount needed to effect perfect plumb of the ICF wall. Alternative means for detecting plumb include affixing a bubble level to each vertical-member or using a laser, or the like, to communicate the same information. If any sort of care was used to fit together the ICF wall, a little rotation of the crank is all that is required. The present invention provides a total of about ten inches of vertical adjustment of the pivot, which is more than ample. Unlike past schemes, the brace-members (which effectively implement a kicker) need not be touched once they are fixed to each other and to the ground or floor.

It is inherent in the present invention that one person may, with ease, erect multiple copies of the present invention and use the present invention to plumb the associated ICF wall. The asymmetrical design of the P-bracket is such that it, and thus the present invention, can be used with every known style of ICF block without needing any additional parts or tools. The inherent stiffness of the vertical-members insure that the wall as a whole will be plumb as a unit. To accommodate a need to adjust a tall wall, an optional bottom vertical-member may be used that is preferably six feet longer than the standard bottom vertical-member.

DETAILED DESCRIPTION OF THE INVENTION AND ITS PREFERRED EMBODIMENT

Figure 1:
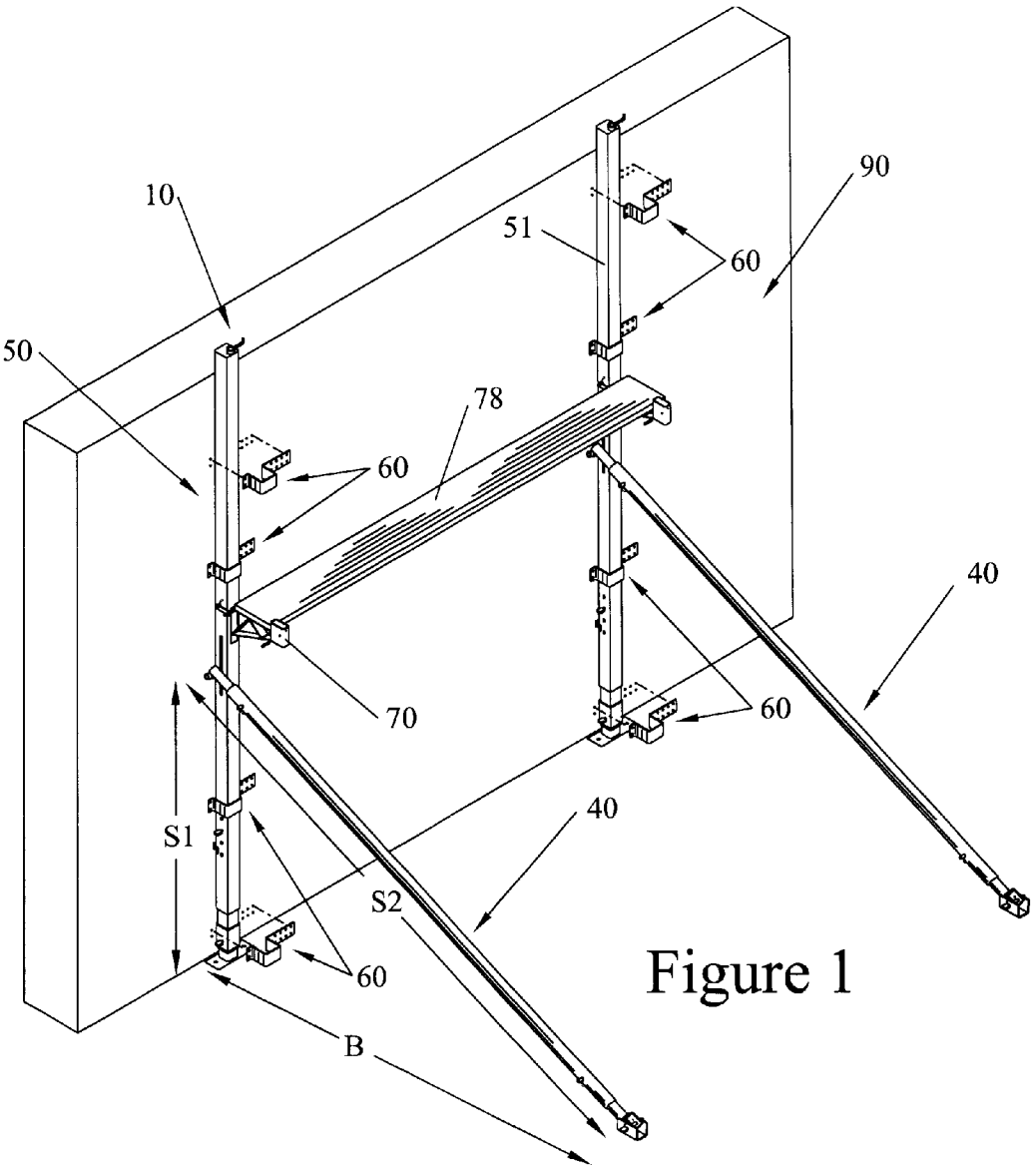
FIG. 1 is a view of two units of the present invention supporting a wall of interlocking expanded polystyrene-construction-blocks. The view includes a platform suspended between the two units, and the distances B, S1, and S2.

The conformity of the present invention, when in use, is shown on FIG. 1 where two units of the preferred embodiment of the present invention are shown supporting and straightening wall 90. Wall 90 (shown with more detail on FIG. 6) is made up of interlocking expanded polystyrene-construction-blocks 92 that customarily are manually stacked and interlocked so that the block's imbedded studs 94 lie along a series of vertical lines. An example of a suitable interlocking expanded polystyrene-construction-block 92 is described in U.S. Pat. No. 5,428,933.

Each unit of the preferred embodiment of the present invention includes crank 10 (to which mechanisms to be described latter are attached) at the top of vertical-member 50 (which is placed essentially vertically against wall 90 and maintained there by P-brackets 60 (which are attached to studs 94)) and brace 40. Platform 78 is held by two or more platform-brackets 70, which extend from, and are supported by, each vertical-member 50.

Figure 4:
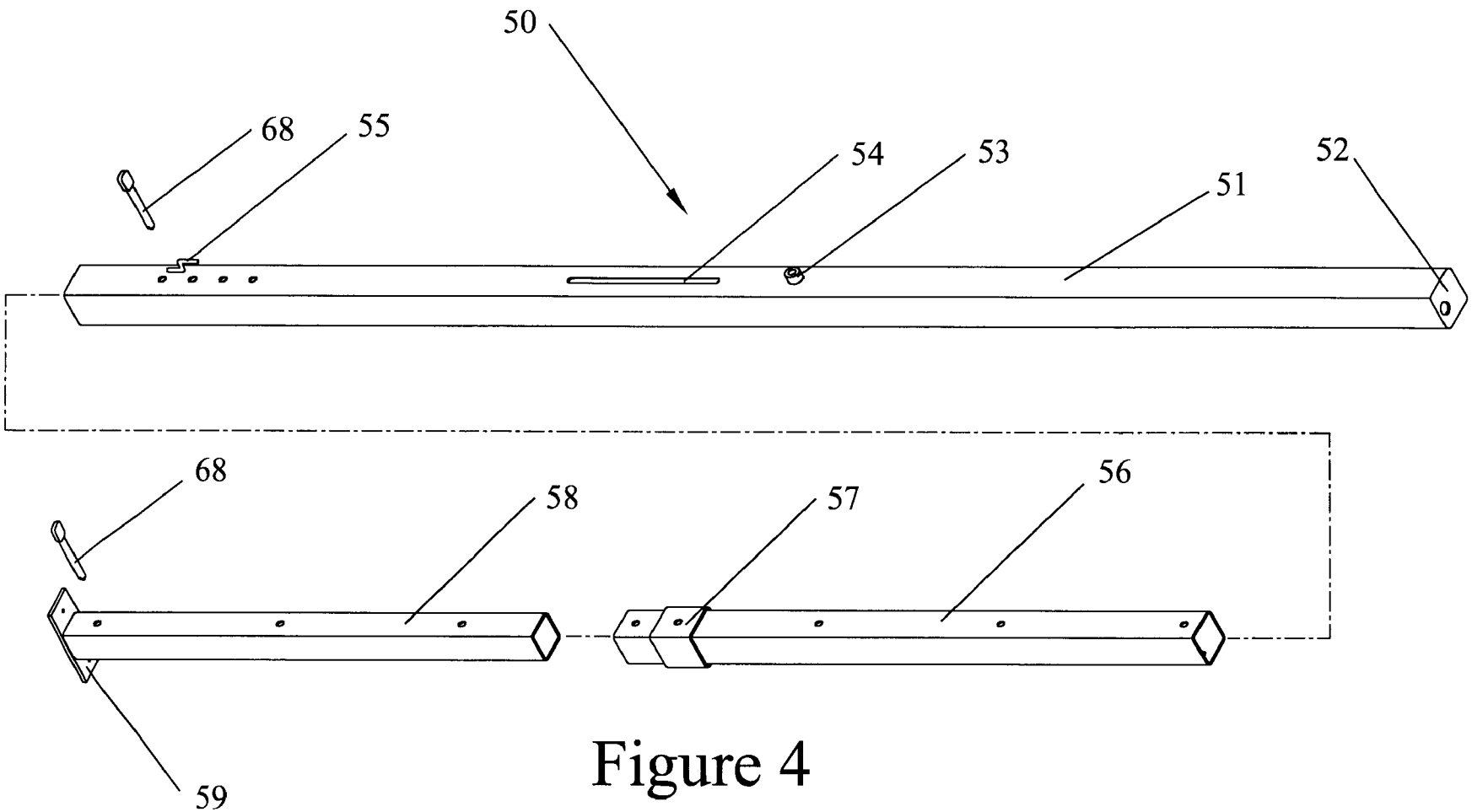
FIG. 4 is a scaled, exploded view of the major parts of the vertical-member. The view includes an exploded view of long pin.

Longitudinal vertical-member 50, which may be seen with more detail on FIG. 4, includes relatively tall top vertical-member 51 that captively nests within itself middle vertical-member 56 and bottom vertical-member 58 with the bottom end of the latter (vertical-member foot 59) being attached to the floor or ground.

Figure 5:
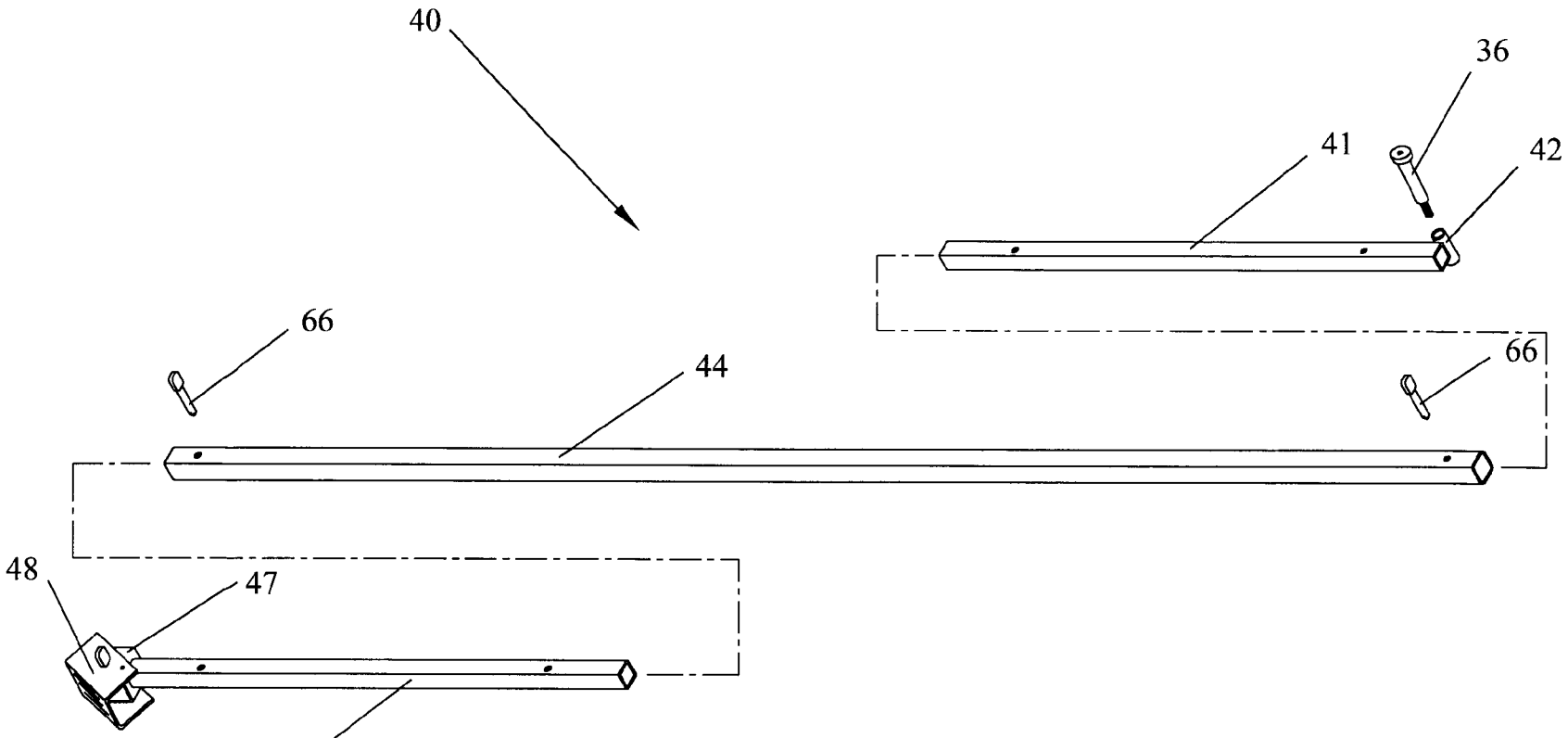
FIG. 5 is a scaled, exploded view of the major parts of the brace-member. The view includes an exploded view of a short pin and the articulatable brace foot.

Longitudinal brace 40, which may be seen with more detail on FIG. 5, includes relatively long middle brace-member 44 that captively nests within itself top brace-member 41 and bottom brace-member 46 with the bottom end of the latter terminating in brace ankle 47 and brace foot 48 that is affixed to the floor or ground. The visible, or top end, of top brace-member 41 terminates in pivot bolt sleeve 42, which is pivotally and adjustably connected to top vertical-member 51, as will be described in more detail.

Figure 3:
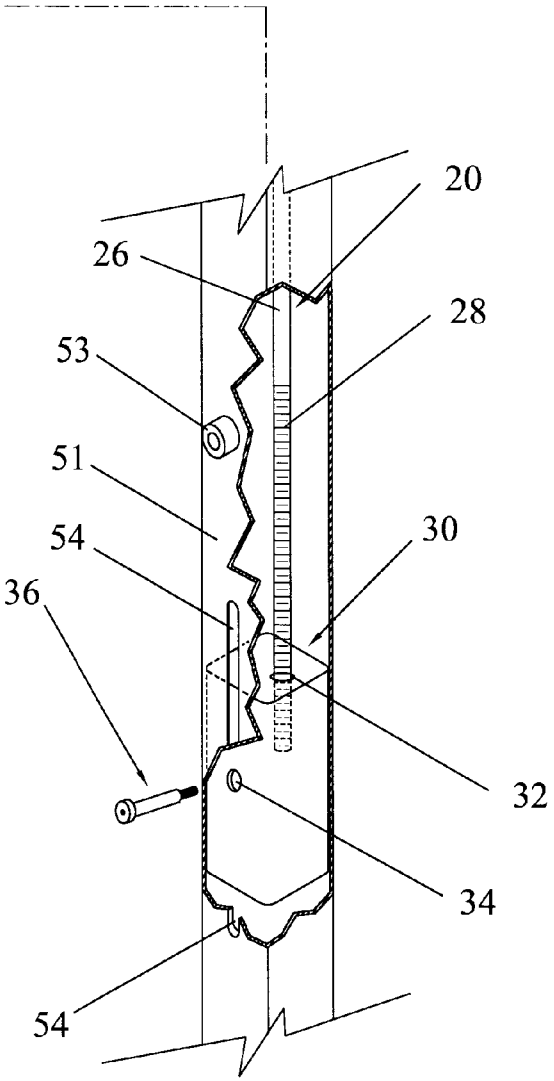
FIG. 3 is a broken-out view of the translator and the bottom portion of the adjusting rod within the top vertical member.
Figure 2:
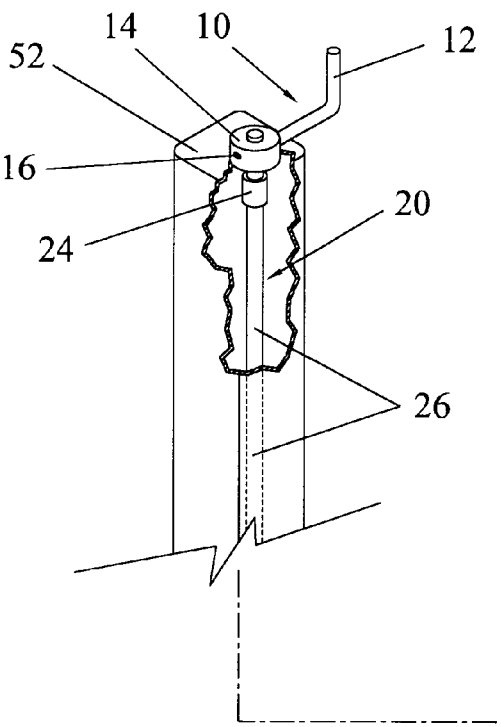
FIG. 2 is a view of the crank, and the upper portion of top vertical-member including a broken-out view of the top portion of the adjustment rod.
Figure 8:
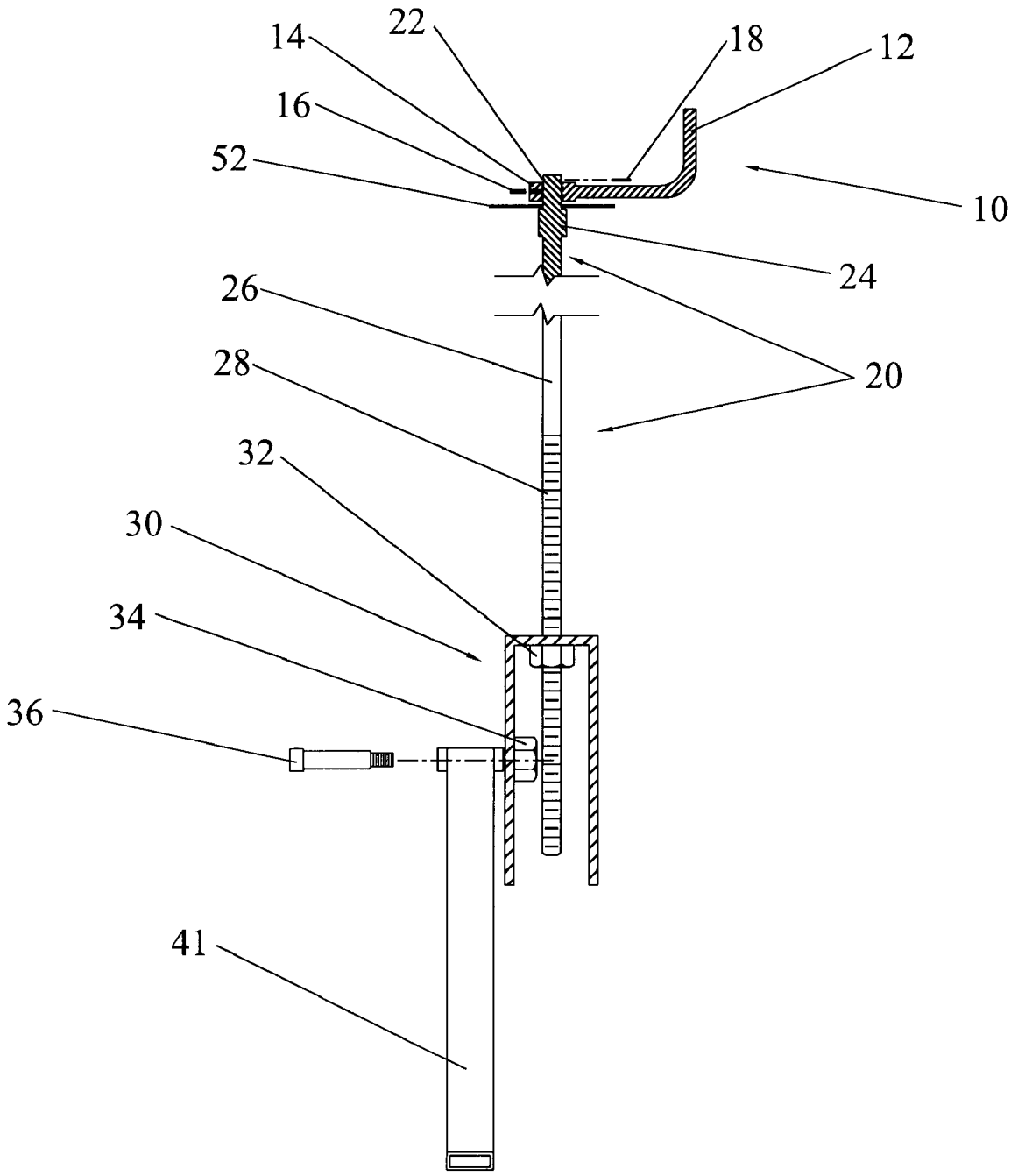
FIG. 8 is a sectional view of the crank and the adjustment rod, and an exploded view of the translator and pivot bolt. For clarity, top vertical-member is not shown on FIG. 8. Refer to FIG. 3 for its placement.

A major objective of the use of the present invention is easy straightening of wall 90. Straightening wall 90 is effected not by changing the length of brace 40, but by changing the site where brace 40 and vertical-member 50 meet. Changing the meeting site is effected by a scheme that may be seen on FIGS. 1, 2, and 3. Additional details may be seen on FIGS. 8 and 9.

An adjustment rod 20 (preferable 52.75 inches long overall) having a shaft 26 that is threaded for its bottom 12 inches to form lead screw 28, and that has a ring 24 near its top, is placed within top vertical-member 51. Cap 52 is the top of top vertical-member 51. The unthreaded end of shaft 26 protrudes through an off-center hole in cap 52 (which is effectively a bushing) and the unthreaded end of shaft 26 is held rotatably captive therein by ring 24 (part of shaft 26) below cap 52 and by crank 10 above cap 52. Crank 10 is preferably held to the end of adjustment rod 20 protruding through cap 52 by the use of split clamping crank collar 14 (half of which is welded to crank handle 12) and crank setscrew 16. The assembled crank 10 is kept from sliding upward and off of adjustment rod 20 by crank retainer 18 placed above crank handle 12 within retainer groove 22. Crank retainer 18 may be a snap ring.

Also within top vertical-member 51 is placed translator 30, a section of square cross-section tubing that is closed at one end. The closed end of translator 30 contains lead screw nut 32 through which lead screw 28 is threaded. Lead screw nut 32 is placed off-center, and directly below the off-center hole in cap 52, for reasons that will become clear. Rotating crank 10 will, of necessity, rotate shaft 26 and thus cause translator 30 to move either up or down within top vertical-member 51 over a maximum travel of about 10 inches.

In one side of top vertical-member 51, and adjacent to the region over which translator 30 can travel within top vertical-member 51, a slot 54 is cut. In the side of translator 30 exposed by slot 54 is placed pivot bolt nut 34, which will receive pivot bolt 36. One may now see why lead screw nut 32, and thus adjustment rod 20, is preferably placed off-center. By placing lead screw nut 32 off-center, lead screw 28 will be to the front side of the horizontal, centrally located part of clevis 76 that extends through platform-bracket attachment 53, and neither device will interfere with the other. Additionally, such an off-center placement of adjustment rod 20 results in the crank handle 12 staying farther from wall 90 when crank 10 is rotated, and thus the placement reduces the chances of pinching the hand doing the rotating.

While the preferred placement of adjustment rod 20 is essentially within vertical-member 50, it is possible to place adjustment rod 20 outside of vertical-member 50 set off on brackets attached to vertical-member 50. The rod and its associated mechanism are protected when inside. Outside placement might be effected at a lower cost.

Brace 40 is pivotally attached to vertical-member 50 by placing pivot bolt sleeve 42 (found at the end of top brace-member 41 and extending normal to the major axis of top brace-member 41) adjacent to pivot bolt nut 34, passing pivot bolt 36 through pivot bolt sleeve 42, and screwing pivot bolt 36 into pivot bolt nut 34 so as to form an adjustable pivot. The pivot bolt sleeve 42 preferably has a circular, internal, through-bore with a major axis that is normal to the major axis of top brace-member 41 and an inside diameter that is slightly larger than the outside of pivot bolt 36. Top brace-member 41 is free to pivot about its attachment to top vertical-member 51 and, as the crank is rotated, the pivot moves up or down. Preferably, the dimensions of slot 54 and of the parts forming the pivot are such that the pivot may travel at least 10 inches.

The parts of the preferred embodiment of vertical-member 50 are shown on FIG. 4 to scale. The relatively tall top vertical-member 51 is preferably a square cross-section steel tube that is 90 inches long, that has an outside dimension of 2.5 inches by 2.5 inches, that has cap 52 provided with an off-center, through-orifice to receive there through the top of shaft 26, that has platform-bracket attachment 53 adapted to receive clevis 76, that has a slot 54 provided in one side with an effective length of about 10 inches long to provide for travel of the pivot between vertical-member 50 and brace 40 as heretofore described, that has a retainer 55 placed near its bottom to be used to retain brace 40 when the assembly of brace 40 and vertical-member 50 is not in use, and that has a series of spaced holes near its bottom to be used in cooperation with similar holes in the other pieces of vertical-member 50 so as to adjust the overall height of vertical-member 50. Middle vertical-member 56 is preferably a square cross-section steel tube that is 38 inches long, that has an outside dimension of 2.25 inches by 2.25 inches, and that is pierced with four sets of through holes spaced vertically from each other by about one foot. Surounding middle vertical-member 56, is sleeve 57 that is a 2.5 inch piece of the same steel tube used to make top vertical-member 51 and serves as an inside spacer when P-bracket 60 needs to be used around middle vertical-member 56. Bottom vertical-member 58 is preferably a square cross-section steel tube that is 31 inches long, that has an outside dimension of 2 inches by 2 inches, that is pierced with three sets of through-holes spaced vertically from each other by about one foot, and that is terminated at its bottom with vertical-member foot 59 that is preferably a plate that is about five inches long and 2.5 inches wide welded to the bottom of bottom vertical-member 58. Vertical-member foot 59 is capable of flexing when vertical-member 50 is tilted, while keeping the bottom of vertical-member 50 next to wall 90. Also shown on FIG. 4 is an exploded view of metal long pin 68. The aforementioned sets of through holes in the three major pieces of vertical-member 50 (top vertical-member 51, middle vertical-member 56, and bottom vertical-member 58) have an inside diameter slightly larger than the outside diameter of long pin 68 and those sets of holes are spaced vertically by equal amounts. In use, multiple long pins 68 are placed through multiple sets of alined holes so as to provide for both incremental adjustability of the overall length of vertical-member 50 and to effect a composite structure that is fairly rigid and able to resist both compressive and tensional forces. The preferable outside diameter of long pin 68 is ⅜ inches with an effective length greater than 2.5 inches.

An alternate embodiment of vertical-member 50 may be effected by the use of an optional bottom vertical-member 58. The optional bottom vertical-member 58 is preferably 72 inches longer than the preferred embodiment of bottom vertical-member 58, thereby effecting an alternative vertical-member 50 that is six feet taller than the preferred embodiment of vertical-member 50.

The preferred embodiment and the described alternate embodiment of vertical-member 50 use three nested members to provide for convenience of use and transport of the present invention. However, it is known to use only two nested members to effect vertical-member 50 and still have adjustability of height. It is also known to use only one member to effect vertical-member 50 with a commensurate reduction in flexibility. The present invention encompasses a vertical-member 50 that includes top vertical-member 51 and from two to zero additional members. The present invention also encompasses the use of aluminum or another strong material in lieu of steel to construct the various parts.

The parts of the preferred embodiment of longitudinal brace 40 are shown on FIG. 5 to scale. The relatively long middle brace-member 44 is preferably a square cross-section metal tube that has outside dimensions of 1.5 inches by 1.5 inches, that is 90 inches long, and that is pierced by sets of holes about five inches from both of its ends.

Top brace-member 41 is nested within middle brace-member 44 and is extendable upward from middle brace-member 44. Top brace-member 41 is critical to the present invention and is preferably a square cross-section metal tube that has outside dimensions of 1.25 inches by 1.25 inches, that is about 34 inches long, and that has pivot bolt sleeve 42 permanently attached by welding, or the like, to the end of top brace-member 41 farthest from the ground and normal to the major axis of top brace-member 41. The pivot bolt sleeve 42 preferably has a circular, internal, through bore with a major axis that is normal to the major axis of top brace-member 41 and an inside diameter that is slightly larger than the outside diameter of pivot bolt 36. The preferred embodiment of the present invention uses only conventional lubrication in conjunction with pivot bolt sleeve 42. It is known to use bearings or bushings in conjunction with pivot bolt sleeve 42.

Bottom brace-member 46 is nested within middle brace-member 44 and is extendable downward from middle brace-member 44. Bottom brace-member 46 is preferably a square cross section metal tube that has outside dimensions of 1.25 inches by 1.25 inches, that is about 34 inches long, and that is terminated by brace ankle 47 and brace foot 48. Brace ankle 47 and brace foot 48 are used to provide a transition from brace 40 to the ground or floor.

Preferably, brace foot 48 is able to articulate, or hinge, with respect to brace 40. In the preferred embodiment of the present invention, brace foot 48 is about five inches long in order to provide suitable contact with the ground or floor. It is possible for brace foot 48 to exist without brace ankle 47.

Top brace-member 41, middle brace-member 44, and bottom brace-member 46 are provided with sets of through holes having an inside diameter slightly larger than the outside diameter of short pin 66. In use, multiple short pins 66, each with an effective length greater than 1.5 inches and a diameter of ⅜ inches, are selectively placed through cooperating and alined holes so as to provide for the incremental adjustability of the overall length of brace 40. Once both vertical-member 50 and brace 40 have had their appropriate length set by aligning holes and placing pins through those holes, those lengths are not changed during the straightening process of wall 90 nor while the two members are supporting wall 90.

While adjustability of the length of brace 40 prior to plumbing the wall 90 is desirable, it is known to use only two nested members to form brace 40 and it is known for brace 40 to consist of just an extended top brace-member 41.

Figure 6:
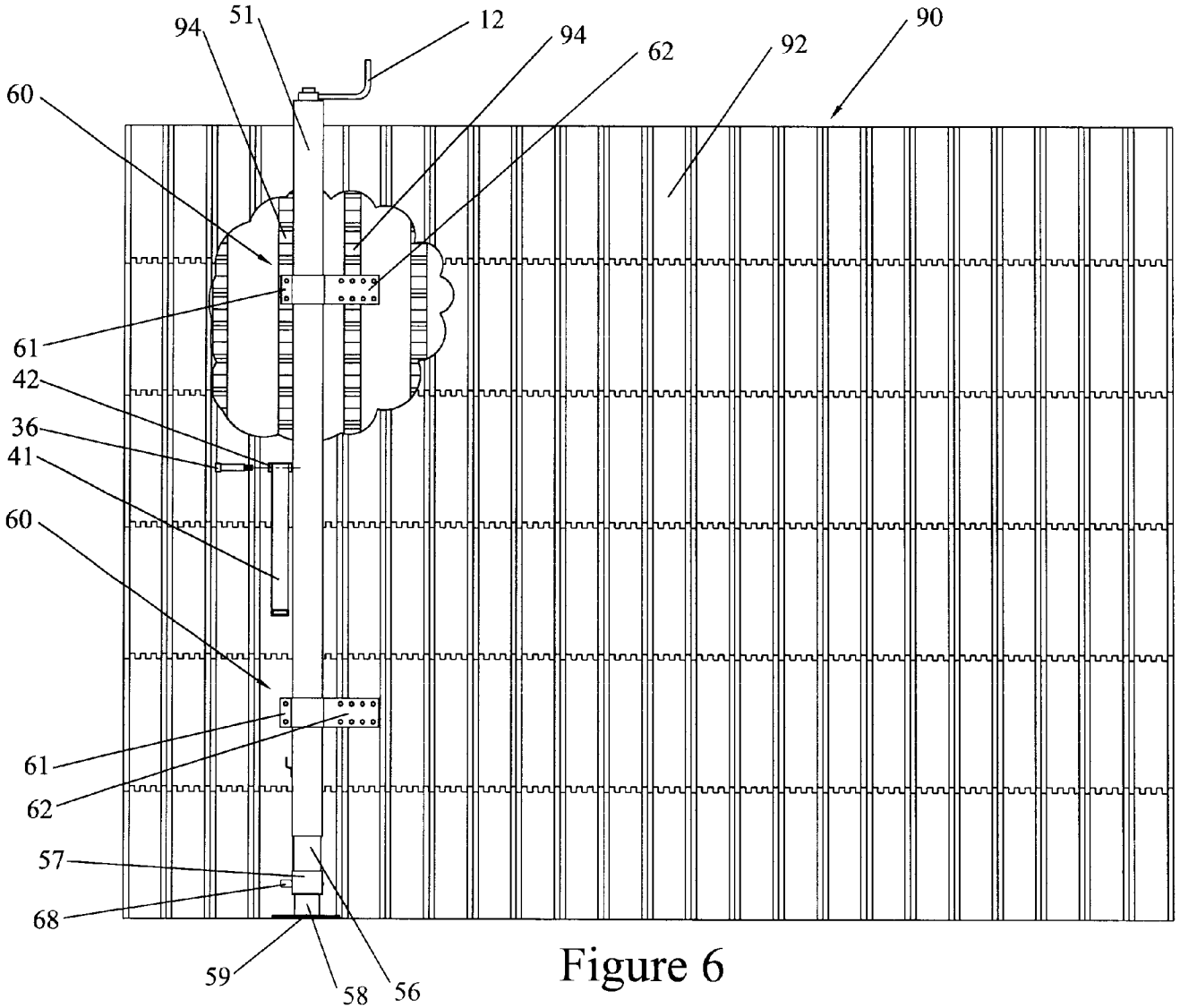
FIG. 6 is an expanded view of the use of the P-bracket to attach the vertical-member to the studs of the interlocking expanded polystyrene-construction-blocks that form the wall.

FIG. 6 shows P-bracket 60 in use with each of its flanges detachably attached to studs 94 of interlocking expanded polystyrene-construction-blocks 92. Different interlocking expanded polystyrene-construction-blocks 92 have different spacings between their studs 94. To be able to be used with any interlocking expanded polystyrene-construction-blocks 92, P-bracket 60 has flanges (short flange 61 and long flange 62) able to bridge between the variously spaced studs and to be detachable attached to those studs. Preferably, the entire P-bracket 60 is about nine inches wide with short flange 61 being about one inch wide, the portion of P-bracket 60 that bridges top vertical-member 51 being about 2.7 inches wide, and long flange 62 being about 5.3 inches wide. Preferably, P-bracket 60 is about 2.5 inches high, made of metal strap, and both flanges are pierced with sets of holes for the use of screws, or the like, to go through. It is to be clear that the preferred mode of using the P-bracket 60 is such that each P-bracket 60 does not prevent small vertical displacement of top vertical-member 51 or of interlocking plastic-construction-blocks 92, such as is expected when wall 90 is being made vertical or when the blocks are being filled with concrete. P-bracket 60 is to hold top vertical-member 51 snugly or firmly, but not tightly.

The unequal lengths of short flange 61 and long flange 62 serve an important purpose. The short flange 61 of each P-bracket 60 is intended to be used on the same side of top vertical-member 51 as slot 54 and brace 40. Placing short flange 61 on the same side of top vertical-member 51 as brace 40, and the narrow width of short flange 61, causes most of the horizontal force produced by the adjustment of crank 10 to be reacted directly into a stud 94 and thus crushing of the expanded polystyrene of the interlocking expanded polystyrene-construction-blocks 92 is avoided.

The process of straightening wall 90 starts after:

- vertical-member 50 has its members extended as desired and pinned together;
- vertical-member 50 is placed essentially vertically against wall 90 and is held snugly thereto by P-brackets 60 attached to studs 94;
- vertical-member foot 59 is affixed to the ground or floor next to wall 90;
- brace 40 has its members extended as desired and pinned together; and
- brace foot 48 is affixed to the ground or floor. It is also assumed that vertical-member 50 and brace 40 are pivotally connected by pivot bolt sleeve 42 being pivotally connected to translator 30 by pivot bolt 36 and pivot bolt nut 34. When all is ready (as just described), a triangle exists with a base (called B herein) extending from brace foot 48 to vertical-member foot 59, with a side (called S1 herein) extending from vertical-member foot 59 up vertical-member 50 to the center of pivot bolt 36, and with another side (called S2 herein) extending from the center of pivot bolt 36 down brace 40 to brace foot 48. B, S1, and S2 are indicated on FIG. 1. ☜ Typically, the angle between S1 and S2 is in the neighborhood of 45 degrees, however that angle could be less than ninety degrees and more than two degrees. Rotating crank 10 in one direction moves translator 30 upward, thus moving pivot bolt 36 upward, and thus lengthening S1. Since neither B nor S2 are capable of noticeable changes in length, the inevitable result is for vertical-member 50 to be rotated about vertical-member foot 59, which is flexible, away from wall 90. Rotating crank 10 in the other direction moves translator 30 downward, thus moving pivot bolt 36 downward, and thus shortening S1. Since neither B nor S2 are capable of noticeable changes in length, the inevitable result is for vertical-member 50 to be rotated about vertical-member foot 59 towards wall 90. The slight rotations of vertical-member 50 require slight vertical movements of top vertical-member 51 within P-brackets 60, which P-brackets 60 are designed to allow. The human who rotates crank 10 must use a level or plum line (or the equivalent) in order to know when crank 10 has been turned enough in the correct direction to effect a straight, vertical wall 90. Neither vertical-member 50 nor brace 40 change length by a noticeable amount while straightening is taking place. However, it is desirable to be able to set the length of vertical-member 50 and the length of brace 40 to a certain value prior to straightening, or plumbing, taking place.

Figure 7:
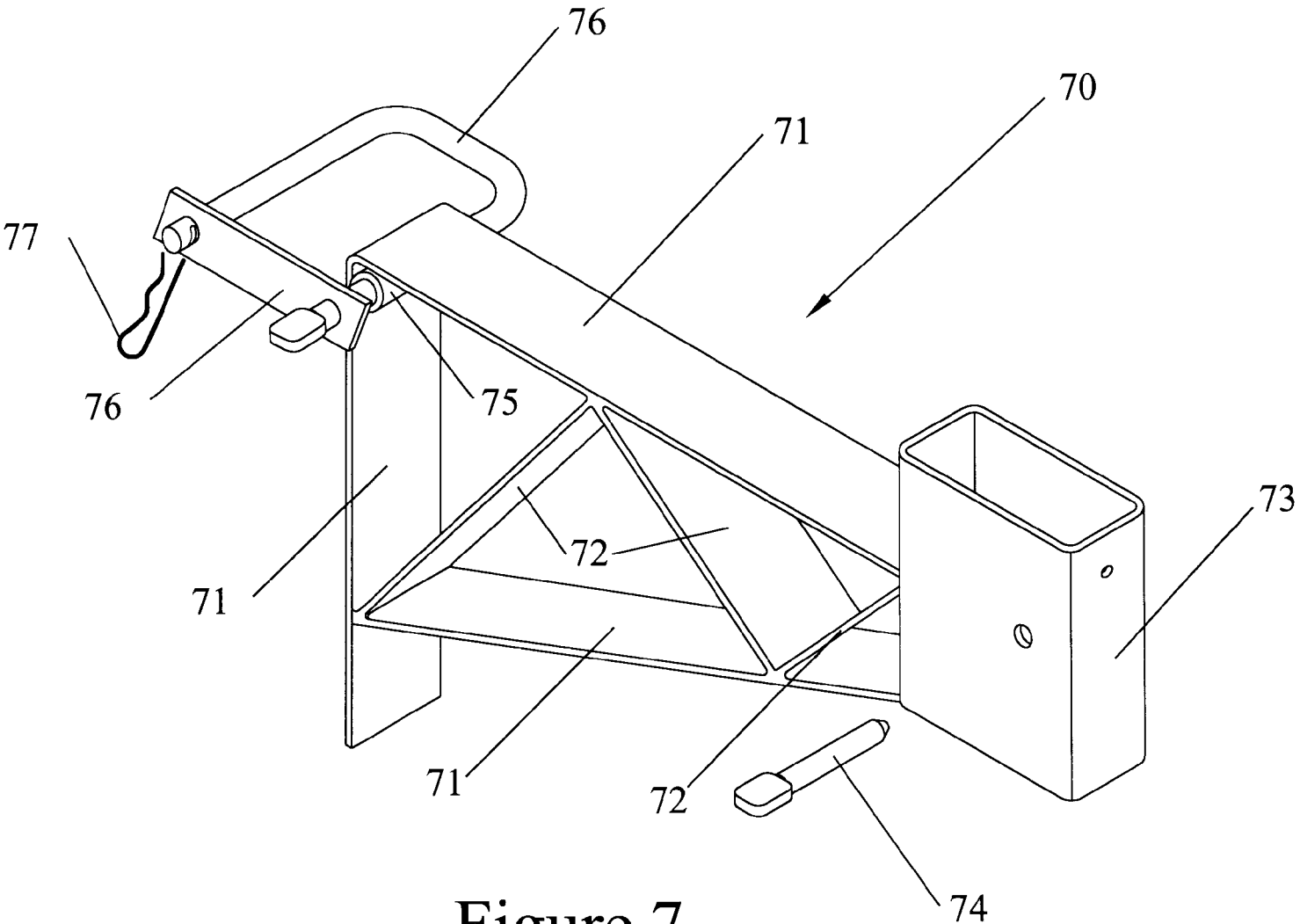
FIG. 7 is an expanded view of the platform bracket.

FIG. 7 shows platform-bracket 70 and FIG. 1 shows a pair of platform-brackets 70 used to effect platform 78. Platform-bracket 70 is generally an L shaped piece of metal with the long part of the L horizontal and the short part vertical. Preferably, platform-bracket 70 includes cup-shaped railing-post retainer 73 placed at the far end of the bracket with inside dimensions to receive a standard 2×4 piece of lumber to be used as a vertical support for a conventional horizontal railing (not shown). Platform-bracket 70 is strengthened by platform-bracket truss 71 and platform-bracket stiffener 72. Platform-bracket 70 has a clevis retainer 75 with a horizontal, cylindrical, through hole at the near end (end nearest to the wall) of the platform-bracket 70. Clevis retainer 75 is adapted to receive one side of clevis 76. The other side of clevis 76 is received by platform-bracket attachment 53 on top vertical-member 51. Clevis 76 is retained by clevis retaining-key 77 and clevis 76 is a closed loop when so retained. Clevis retaining-key 77 also facilitates detaching and re-attaching the assembly of clevis 76 and platform-bracket 70 to, and from, top vertical-member 51.

In use, clevis retaining-key 77 is unlocked, top vertical-member 51 receives clevis 76, clevis retaining-key 77 is locked allowing platform-bracket 70 to hang from top vertical-member 51, platform 78 is placed on top of platform-bracket 70, and a railing is formed using railing-post retainer 73. The assembly of clevis 76 and platform-bracket 70 could be permanently affixed to top vertical-member 51, or platform-bracket 70 permanently affixed to top vertical-member 51 without the use of clevis 76, with the loss of flexibility and with the resulting package much more awkward to transport than is the preferred embodiment.

Figure 9:
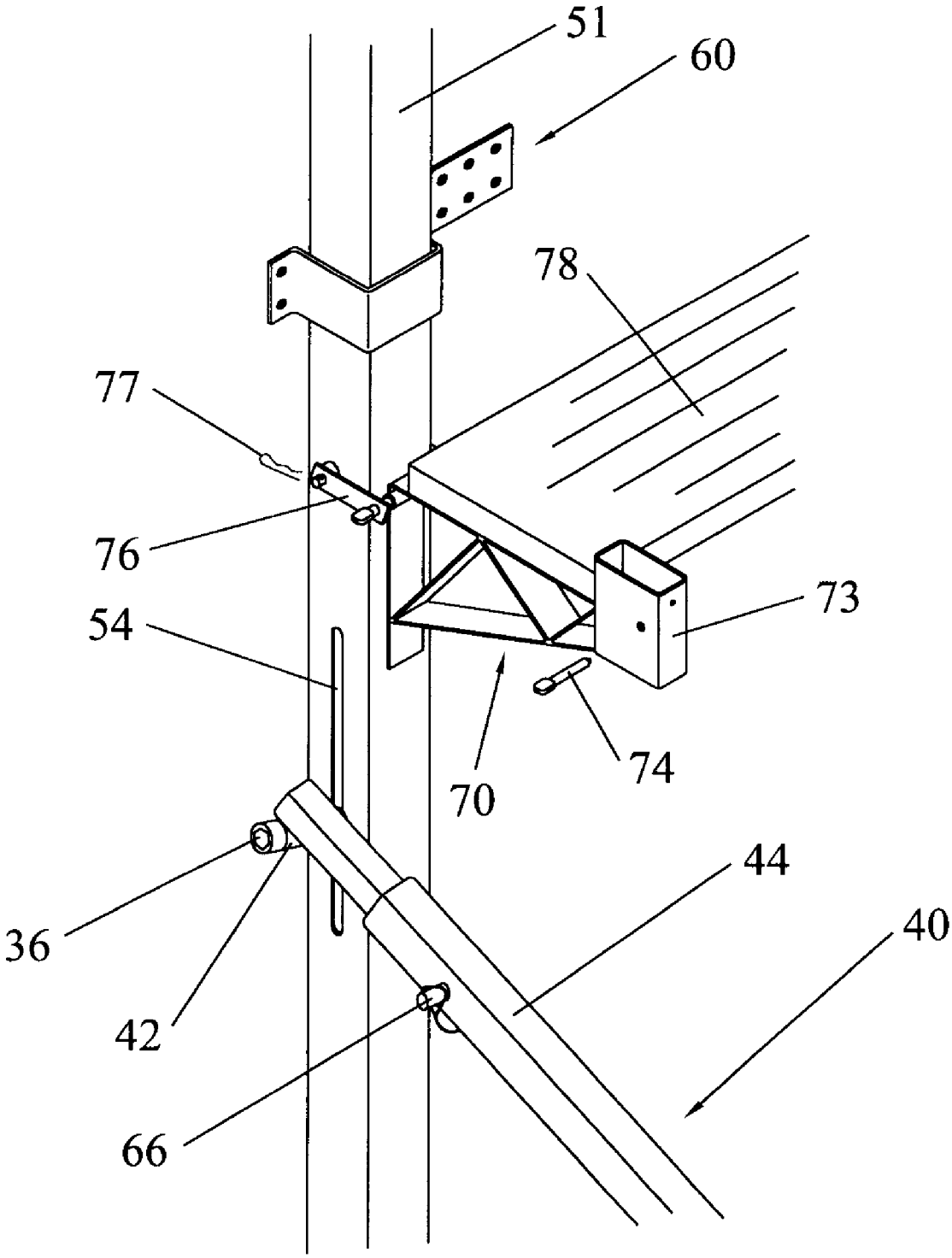
FIG. 9 is an expanded view of the top vertical-member, pivot, P-bracket, and the platform bracket.

Details of the mounting of platform-bracket 70 to top vertical-member 51 may be seen on FIG. 9. FIG. 9 also provides a side view of much of the pivot (slot 54, pivot bolt sleeve 42, and pivot bolt 36).

Figure 10:
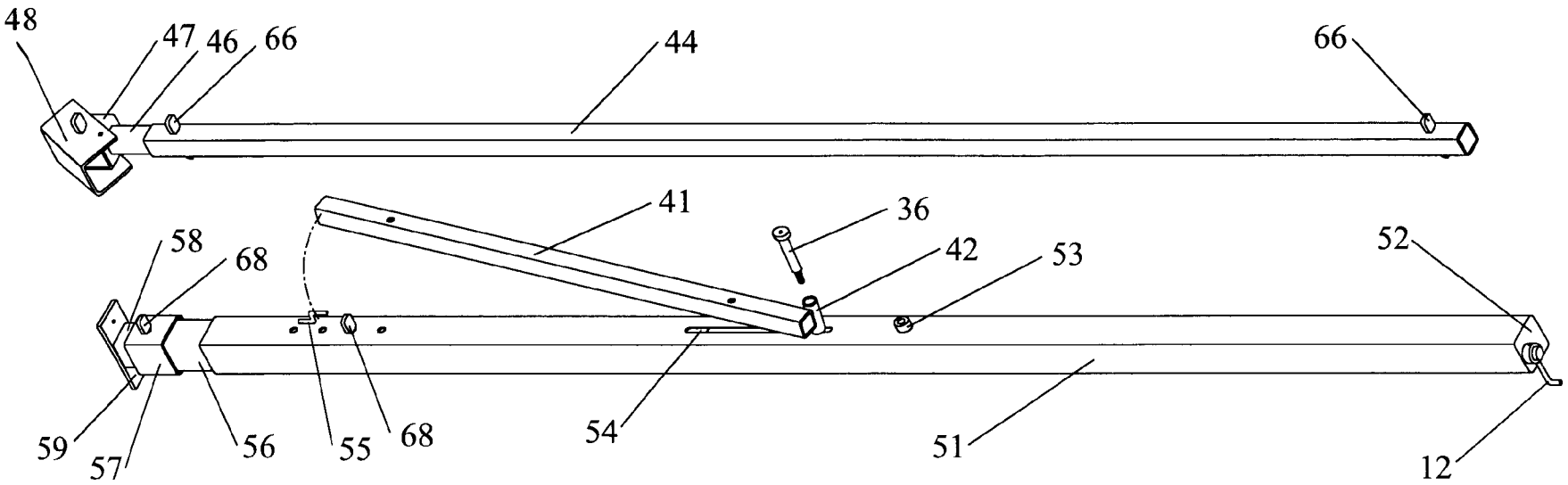
FIG. 10 is a view of a unit of the present invention with elements stowed for shipping and shows the use of the retainer.

FIG. 10 shows the compact package that brace 40 and vertical-member 50 may form when prepared for transport. The platform 78, railing, and the assembly of clevis 76 and platform-bracket 70 are removed when wall 90 has been straightened, filled with concrete, and the concrete has hardened. Then the P-brackets 60 are removed from the wall, brace foot 48 is detached from the ground or floor, and vertical-member foot 59 is detached from the ground or floor. Short pins 66 and long pins 68 are removed, the three sections of vertical-member 50 are nested and pinned together, and the bottom two sections of brace 40 (middle brace-member 44 and bottom brace-member 46) are removed from top brace-member 41 and nested and pinned together. Top brace-member 41 and vertical-member 50 are rotated into side-by-side alignment. Retainer 55 is preferably a short vertical post placed near the bottom of top vertical-member 51, slightly offset from top vertical-member 51, and open upward. Crank 10 is rotated so as to position translator 30 until the bottom of top brace-member 41 is just above retainer 55. The bottom of top brace-member 41 is positioned over retainer 55 and crank 10 rotated so as to lower translator 30 enough to capture the bottom of top brace-member 41 on retainer 55. The result is a pair of compact packages with nothing to flop about.

The preferred embodiment of the present invention has been described in detail including variations of the same. The embodiments described are illustrative and not restrictive.

We claim:

1. An apparatus for plumbing a wall formed of insulating concrete forms (ICFs) that extends upward from a floor, comprising:

a longitudinal vertical member having a lower end attached to the floor next to the wall, an upper end, a first side, a second side, a longitudinally movable pivot intermediate of said lower end and said upper end, and adjustment means for moving said movable pivot longitudinally;

a longitudinal brace member having a pivot end pivotally attached to said movable pivot of said vertical member, and a distal end attached to the floor a distance from the wall such that the acute angle between said vertical member and said attached brace member is less than ninety degrees and more than two degrees; and one or more asymmetrical brackets firmly attaching said vertical member to the wall, said brackets having a first flange extending from said first side of said vertical member and a second flange extending from said second side of said vertical member.

2. The apparatus of claim 1 wherein said vertical member further includes length setting means for setting the length of said vertical member to a certain value.

3. The apparatus of claim 2 wherein said length setting means comprises a plurality of nesting sections capable of being pinned to each other so as to set the length of said vertical member to a certain value.

4. The apparatus of claim 1 wherein said brace member further includes length setting means for setting the length of said brace member to a certain value.

5. The apparatus of claim 4 wherein said length setting means comprises a plurality of nesting sections capable of being pinned to each other so as to set the length of said brace member to a certain value.

6. The apparatus of claim 1 wherein said vertical member further includes means for attaching a scaffold intermediate of said movable pivot and said upper end of said vertical member.

7. The apparatus of claim 1 wherein said adjustment means comprises a shaft with a threaded end forming a lead screw threadedly coupled to said movable pivot, and an unthreaded end rotatably captured and attached to a crank, whereby the rotation of said crank rotates said shaft and moves said movable pivot.

8. The apparatus of claim 7 wherein said shaft is essentially within said vertical member and said crank is outside of said vertical member.

9. The apparatus of claim 1 wherein said lower end of said vertical member further includes a foot capable of flexing that is attached to the floor.

10. The apparatus of claim 1 wherein said distal end of said brace member further includes an articulatable foot that is attached to the floor.

11. An apparatus for plumbing a wall formed of insulating concrete forms (ICFs) that extends upward from a floor where the ICFs have adjacent vertical columns of attachment studs, comprising:

a longitudinal vertical member having a lower end with a foot capable of flexing attached to the floor next to the wall, an upper end, a first side, a second side, a longitudinally movable pivot on said first side and between said lower end and said upper end, and adjustment means for moving said movable pivot longitudinally;

a longitudinal brace member having a pivot end pivotally attached to said movable pivot of said vertical member, and a distal end with an articulatable foot attached to the floor a distance from the wall such that the acute angle between said vertical member and said attached brace member is less than ninety degrees and more than two degrees; and one or more asymmetrical brackets firmly attaching said vertical member to the wall, said brackets having a first flange extending from said first side of said vertical member and a second flange extending from said second side of said vertical member.

12. The apparatus of claim 11 wherein said first flange of said asymmetrical bracket surmounts and is attached to a stud within four inches of said first side and said second flange surmounts and is attached to an adjacent stud.

13. The apparatus of claim 11 wherein said adjustment means comprises a shaft with a threaded end forming a lead screw threadedly coupled to said movable pivot, and an unthreaded end rotatably captured and attached to a crank, whereby the rotation of said crank rotates said shaft and moves said movable pivot.

14. An apparatus for plumbing a wall formed of insulating concrete forms (ICFs) that extends upward from a floor, comprising:

a longitudinal vertical member having a lower end attached to the floor next to the wall, an upper end, a longitudinally movable pivot intermediate of said lower end and said upper end, and adjustment means for moving said movable pivot longitudinally;

a longitudinal brace member having a pivot end pivotally attached to said movable pivot of said vertical member, and a distal end attached to the floor a distance from the wall such that the acute angle between said vertical member and said attached brace member is less than ninety degrees and more than two degrees; and means for firmly attaching said vertical member to the wall.

15. The apparatus of claim 14 wherein said adjustment means comprises a shaft with a threaded end forming a lead screw threadedly coupled to said movable pivot, and an unthreaded end rotatably captured and attached to a crank, whereby the rotation of said crank rotates said shaft and moves said movable pivot.

16. The apparatus of claim 15 wherein said shaft is essentially within said vertical member and said crank is outside of said vertical member.

17. The apparatus of claim 14 wherein said lower end of said vertical member further includes a foot capable of flexing that is attached to the floor.

18. The apparatus of claim 14 wherein said distal end of said brace member further includes an articulatable foot that is attached to the floor.

19. The apparatus of claim 14 wherein said means for firmly attaching said vertical member to the wall comprises one or more flanged brackets placed firmly around said vertical member with flanges attached to the wall.

20. The apparatus of claim 14 wherein said vertical member further includes length setting means for setting the length of said vertical member to a certain value.

21. The apparatus of claim 14 wherein said brace member further includes length setting means for setting the length of said brace member to a certain value.

* * * * *